United States Patent [19]

Gall

[11] 4,354,222

[45] Oct. 12, 1982

[54] KNOCK-DOWN LAMP SHADE

[75] Inventor: John C. Gall, Chicago, Ill.

[73] Assignee: Sears, Roebuck and Co., Chicago, Ill.

[21] Appl. No.: 159,083

[22] Filed: Jun. 13, 1980

Related U.S. Application Data

[63] Continuation of Ser. No. 919,757, Jun. 28, 1978, abandoned.

[51] Int. Cl.[3] ..... F21V 1/06

[52] U.S. Cl. ..... 362/352

[58] Field of Search ..... 362/352

[56] References Cited

U.S. PATENT DOCUMENTS

| | | | |
|---|---|---|---|
| 856,190 | 6/1907 | Baumer . | |
| 1,072,815 | 9/1913 | Brady . | |
| 1,196,523 | 8/1916 | Clark . | |
| 1,319,092 | 10/1919 | Kaufman . | |
| 1,404,663 | 1/1922 | Smith . | |
| 1,759,093 | 5/1930 | Clawson . | |
| 1,867,562 | 7/1932 | Burke | 362/352 |
| 2,005,531 | 6/1935 | Brandstein . | |
| 2,037,941 | 4/1936 | Stadler . | |
| 2,122,971 | 7/1938 | Angeletti . | |
| 2,171,137 | 8/1939 | Burke . | |
| 2,206,508 | 7/1940 | LaBuda . | |
| 2,264,255 | 11/1941 | Burke . | |
| 2,392,324 | 1/1946 | Krebeck . | |
| 2,400,944 | 5/1946 | Morgenroth . | |
| 2,538,676 | 1/1951 | Enright | 362/352 |
| 2,585,248 | 2/1952 | Johnson . | |
| 2,625,648 | 1/1953 | Zenda . | |
| 2,683,801 | 7/1954 | Faselt . | |
| 2,702,341 | 2/1955 | Tradelius . | |
| 2,711,476 | 6/1955 | Wells . | |
| 2,732,489 | 1/1956 | Leech . | |
| 2,796,517 | 6/1957 | Herzfelder . | |
| 2,817,008 | 12/1957 | Cloer . | |
| 2,819,386 | 1/1958 | Linderoth . | |
| 2,853,598 | 9/1958 | Balthauser . | |
| 2,884,515 | 4/1959 | Fogel . | |
| 3,022,417 | 2/1962 | Linderoth . | |
| 3,023,307 | 2/1962 | Okamoto . | |
| 3,075,074 | 1/1963 | Asher . | |
| 3,142,446 | 7/1964 | Okamoto . | |
| 3,155,349 | 11/1964 | Derman et al. . | |
| 3,180,982 | 4/1965 | Derman et al. . | |
| 3,364,349 | 1/1968 | Witz . | |
| 3,435,205 | 3/1969 | Paul . | |
| 3,557,362 | 1/1971 | White et al. . | |
| 3,689,762 | 9/1972 | Shatan . | |
| 3,764,801 | 10/1973 | Mainieks . | |
| 4,055,760 | 10/1977 | Woisbrod | 362/352 |

*Primary Examiner*—Irwin Gluck

*Attorney, Agent, or Firm*—Arnstein, Gluck & Lehr

[57] ABSTRACT

A lampshade which is shipped and/or stored in a knock-down condition can be readily erected without tools into a shade which is as structurally sound as if manufactured in preassembled condition. The shade is formed of two ring members, one having a spider member affixed thereto; a plurality of rib members; a plurality of clamping members having means for releasably securing clamping member to a rib member and a ring member, and hence the latter to each other; and a lamp shade frame cover adapted to be placed about the other members in the assembled condition.

3 Claims, 7 Drawing Figures

KNOCK-DOWN LAMP SHADE

This application is a continuation of application Ser. No. 919,757, filed June 28, 1978, now abandoned.

TECHNICAL FIELD

This invention relates to an improved lamp shade. More particularly, this invention relates to an improved knock-down lamp shade which can be shipped and stored in a substantially flat condition and erected without the use of tools.

BACKGROUND ART

Commonly, lamp shades are manufactured in a formed or erected condition, prior to being shipped. These lamp shades require considerable and inordinate storage and shipping space compared to the weight of the materials. This is particularly evident in the case of cylindrical or box-shaped shades. While tapered or frustoconical shaped shades may be nested or stacked, the nest or stack of shades still requires an inordinate amount of space. Moreover, shades having decorative covers with an irregular surface, such as with trim strips at the upper or lower or both edges of the shade cover, may be damaged and the strips torn during the nesting and unnesting operations.

Modern merchandising practices often require items, such as lamp shades, to be shipped and stored in individual packages for convenient delivery to the customer. Lamp shades which are preassembled or manufactured in the erected conditions cannot be inexpensively stored or shipped in individual containers.

Numerous attempts have been made to construct collapsible or knock-down shades that can be stored and shipped compactly and then assembled by the consumer. However, many of the shades previously proposed depend upon an outer, relatively rigid material for the structural integrity of the erected shade and thus limit the shape and decorative features of the shade. Examples of shades of this type are disclosed in U.S. Pat. Nos. 3,142,446; 3,764,801; 3,787,676 and 4,055,760. Attempts have also been made to provide a collapsible lamp shade in which the erecting operation requires adhesive strips. Examples of such attempts are found in U.S. Pat. Nos. 3,142,446 and 4,055,760. However, the necessity of the consumer having to align parts of the shade and apply adhesive or adhesive strips in the erecting operation detracts from the merchandisability of the item. For these and other resons, the knock-down shades prior to the present invention have not attained commercial acceptability.

DISCLOSURE OF INVENTION

Accordingly, an object of the present invention is to provide a knock-down lamp shade which can be economically stored and shipped in a substantially flat condition.

Another object of the present invention is to provide a knock-down lamp shade which can be readily and quickly assembled by the consumer without the use of tools.

A further object of the present invention is to provide a knock-down lamp shade which can be stored, shipped and packaged substantially flat and upon erection is as structurally sound as preassembled or erected shades.

Still another object is to provide a knock-down lamp shade construction which upon assembly has substantially the same aesthetic appeal found in conventional factory-assembled lamp shades.

A still further object is to provide a knock-down lamp shade construction adaptable for a variety of lamp shade configurations.

These and other objects and advantages of this invention will become apparent from the following description when the same is considered in connection with the accompanying drawings.

The foregoing objects and advantages are attained by the present invention in which a knock-down lamp shade is provided comprising a pair of upper and lower ring members, a spider member, a plurality of rib members, a plurality of clamping members, each of which are attachable to secure a rib member to one of the ring members, and a lamp shade frame cover adapted to be stored in a substantially flat condition. More particularly, the ring members may be of any shape, for example, circular, square, rectangular, oval, elliptical and the like. The configuration of the ring members will determine, to a large extent, the configuration of the lamp shade. The spider member comprises a central member which is adapted to be supported by a lamp, and a plurality of spaced, radially positioned arms each affixed at one end to the central member and at the other end to the upper ring member. The rib members are positionable between the ring members when the latter are axially spaced from each other. Preferably at least three rib members are utilized which are spaced equidistantly about the ring members. The clamping members each include clamping means for releasably securing the clamping member to one of the rib members and for releasably securing the clamping member to one of the ring members, thereby securing the rib member to the ring member. Upon erection of the lamp shade, first by assembly of the clamping members to the rib members and then to the ring members in their axially spaced condition, a lamp shade frame is formed which is structurally sound and self-supporting. The lamp shade frame cover is adapted to be placed about the ring members and the rib members in the erected condition to form the assembled lamp shade.

BEST MODE FOR CARRYING OUT THE INVENTION

Figure 1:
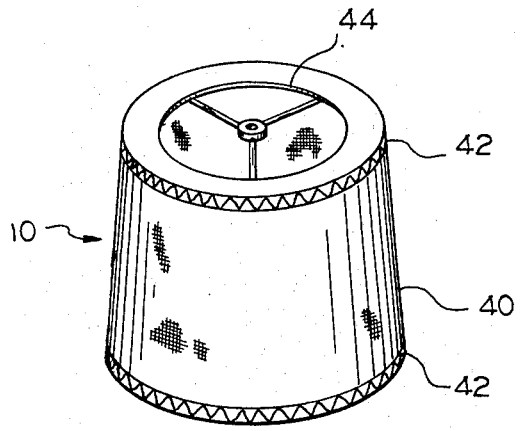
FIG. 1 is a perspective view of an erected lamp shade in accordance with the present invention.

Referring to the drawings, the numeral 10 indicates generally a lamp shade in accordance with the present invention. Lamp shade 10 is fructoconical in shape, as shown, or can be of other shapes such as cylindrical, rectangular, or oval.

Figure 2:
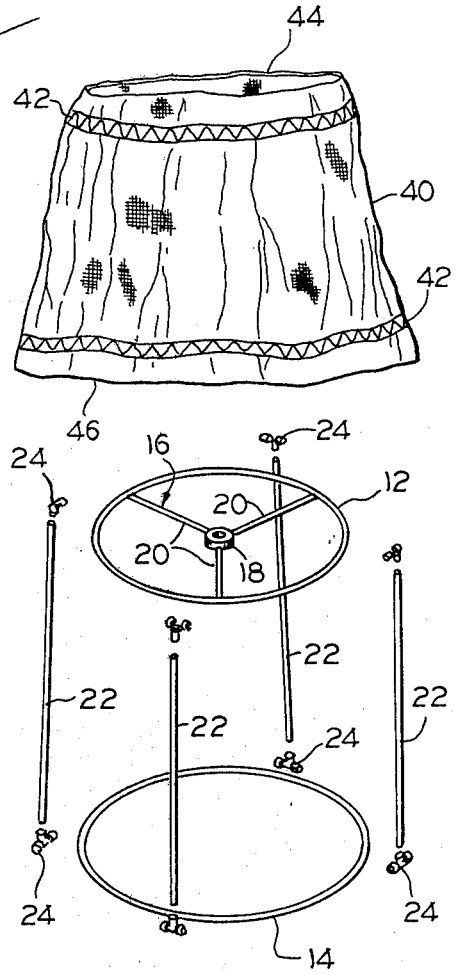
FIG. 2 is an exploded perspective view of the lamp shade of FIG. 1 illustrating the components of the shade with broken lines indicating their assembly.

As shown in FIG. 2, lamp shade 10 has an upper ring member 12 and a lower ring member 14. A spider member, generally indicated by numeral 16, comprises a central member 18 and a plurality of arms 20. Central member 18 may be ring-shaped and is adapted to be supported by a lamp, for example by the harp of a lamp. Arms 20 are preferably spaced from each other and radially positioned, and each is affixed at one end to central member 18 and at the other end to upper ring member 12. Arms 20 of spider member 16 and upper ring 12 can be formed of wire and the arms 20 affixed to central member 18 and to upper ring member 12 by brazing, soldering or other methods, or by fasteners. Spider member 16 and upper ring member 12 can be formed to lie in a single plane, as shown, or arms 20 can be bent so that central member 18 lies in a different plane from ring member 12. For ease of packaging and material economy, it is preferred to have members 16 and 12 lie in the same plane.

Figure 3:
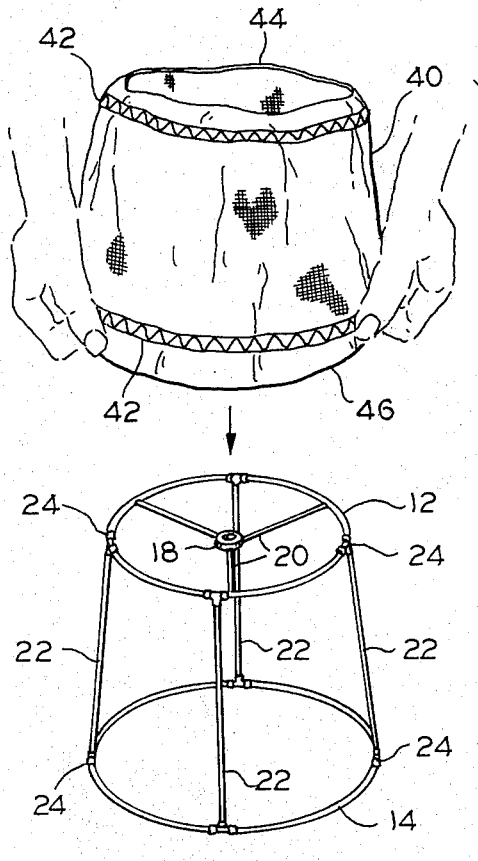
FIG. 3 is an exploded perspective view of the shade of FIGS. 1 and 2 illustrating the assembly of the lamp shade frame cover over the erected frame.

Lamp shade 10 further includes rib members 22 which are positionable between ring members 12 and 14 when the latter are in an axially spaced condition, as shown in FIGS. 2 and 3. Rib members 22 as well as lower ring member 14 can be formed of wire. It is preferable to have at least four rib members 22 to provide a sturdy lamp shade when erected and larger numbers of rib members can be used, particularly when the ring members are of other shapes, such as oval, rectangular or square, to form a lamp shade of non-cylindrical or non-frustoconical shape.

Lamp shade 10 further includes clamping members 24, each clamping member having means for receiving and releasably securing the clamping member to one of the rib members 22 and for receiving and releasably securing the clamping member to one of the ring members 12 or 14. As more particularly shown in FIGS. 4–7, clamping member 24, which may be formed of steel or a molded polymer, commonly known as molded plastic, is formed with at least two portions, 26 and 28, which serve as first and second clamping means, respectively, as will be described in greater detail. In the preferred embodiment of this invention, clamping member 24 has a pair of the second clamping means, the first being portion 28 as noted above, and the second being a portion 30 which is identical to portion 28, but positioned on the side of member 24 away from portion 28 with respect to portion 26. Member 24 is preferably stamped from a generally triangular piece of material or molded into a generally triangular shape as shown in the drawings. Material between portions 28 and 30 can be omitted for a saving of material. However, if desired, portions 28 and 30 can comprise a single portion extending across the width of member 24 and joining the two portions.

Figure 5:
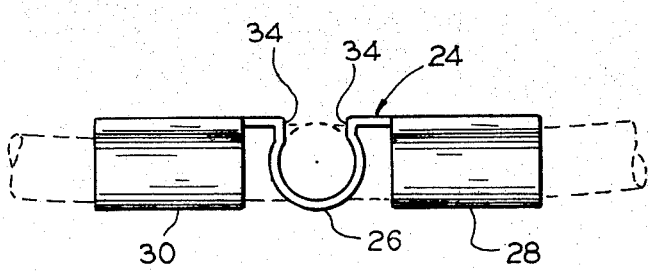
FIG. 5 is a top plan view of the clamping member shown in FIG. 4.
Figure 7:
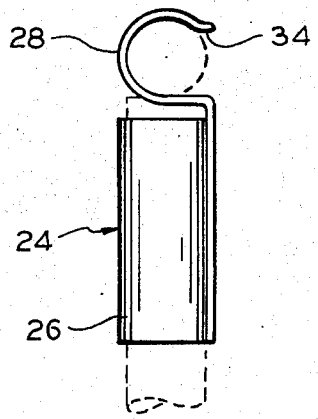
FIG. 7 is a side view of the clamping member shown in FIGS. 4–6.

Portion 26 of member 24 is preferably U-shaped as best seen in FIG. 5, the U-shaped portion having an internal diameter approximately equal to the diameter of rib member 22. Portion 28, as well as portion 30 which is identical thereto, is preferably C-shaped, as best shown in FIG. 7, with the internal diameter of the C-shaped portion being approximately equal to the diameter of ring member 12 or 14 to be releasably secured thereto. Portions 28 and 30 are positioned along a line which is substantially at a right angle to portion 26 and its center line. In this manner, portion 26 is substantially at a right angle to portions 28 and 30.

Clamping member 24 has a generally planar body portion with the open end of U-shaped portion 26 extending along one axis of the body portion of member 24. The closed side of U-shaped portion 26 extends from the plane of the body portion of member 24 in one direction normal thereto. C-shaped portions 28 and 30 have their open ends extending along a line within the plane of the generally planar body portion of member 24 with the line being substantially perpendicular to the axis along which portion 26 extends. The line along which portions 28 and 30 extend is spaced from the end 32 of portion 26. The closed side of C-shaped portions 28 and 30 also extend from the plane of the body portion of member 24 in the same direction normal thereto as the closed side of portion 26. Portions 28 and 30 each have substantially upturned wall portions 34 and 36, respectively, adjacent the plane of the body portion of clamping member 24 which assist in guiding one of the ring member 12 or 14 into the clamping portion during assembly.

In accordance with this invention, lamp shade 10 is intended to be shipped and/or stored in a knock-down condition with its component parts stacked or residing side by side in a substantially flat container. For this purpose, lamp shade 10 includes a lamp shade frame cover 40 which is adapted to be stored in a substantially flat condition. Cover 40 may be of any suitable material, for example fabric, as shown, and may have one or more decorative bands 42 positioned about the periphery of cover 40. Shade cover 40 can also include an elastic band 44 secured to an upper margin thereof and also a second elastic band 46 secured to the lower margin of cover 40.

Figure 4:
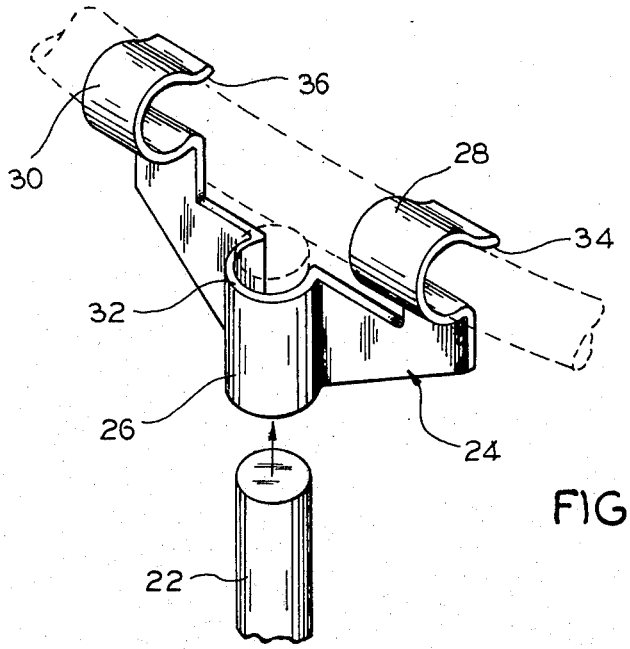
FIG. 4 is an enlarged exploded perspective view of a clamping member and a portion of a rib member in accordance with the present invention with broken lines indicatig the position of the rib member and a ring member in the erected condition.
Figure 6:
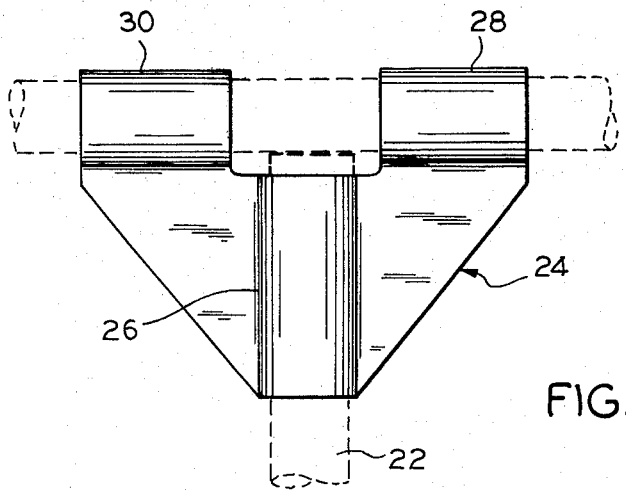
FIG. 6 is a front view of the clamping member shown in FIG. 4 with portions of a rib member and a ring member shown by broken lines in an erected condition.

Upon arrival at the location where the shade is to be used, normally at the customer's location, shade 10 can be readily and easily erected without tools. Clamping members 24 are placed over the ends of rib members 22 and the latter inserted into U-shaped portions 26 of clamping members 24 as shown in FIG. 4. Rib members 22 with clamping members 24 releasably secured at each end thereof are positioned along side and between ring members 12 and 14 as best shown in FIG. 2. Each of clamping members 24 in turn is then releasably secured to the facing ring member by inserting the ring member into the portions 28 and 30 as indicated in FIG. 2, and compressing the rings axially until the ends of the ribs 22 abut the rings, as shown in FIG. 6. Upon completion of the insertion of the ring members into the portions 28 and 30 of clamping member 24, the components, except for the cover 40, are releasably assembled into a relatively rigid lamp shade frame which is structurally as sound as a pre-assembled frame. The final step in the erection of the lamp shade 10 is to place the shade cover 40 over and about the thus formed frame as best shown in FIG. 3. Elastic bands 44 and 46 serve to maintain the cover 40 taut about the assembled frame.

Various changes coming within the spirit of my invention may suggest themselves to those skilled in the art; hence, the invention is not limited to the specific embodiments shown and described or uses mentioned, but the same is intended to be merely exemplary, the scope of the invention being limited only by the appended claims.

I claim:

1. A knock-down lamp shade comprising (a) a knock-down frame composed of upper and lower integral and completely closed ring members with a plurality of peripherally spaced rib members extending therebetween, (b) a flexible skirt-like cover adapted to be spread from a flattened condition for sliding over the exterior of said frame in surrounding and substantially tightly form-fitting relation thereto, (c) said upper ring member including a spider member having a central member and a plurality of spaced radially positioned arms, each affixed at one end to said central member and at the other end to the periphery of said upper ring member, and (d) a plurality of discrete clamping members for positioning at each end of said rib members for interconnecting the latter with said ring members, each clamping member having vertical medial clamping means for releasably engaging said last-mentioned end, and a pair of branched horizontally disposed clamping means extending transversely from said first-mentioned clamping means for releasably engaging the portions of said ring members adjacent to and on the opposite sides of said rib members.

2. An article as set forth in claim 1, wherein said ring members and said rib members are formed of wire and said first-mentioned clamping means is comprised of resililent sheet material having a central vertical portion of U-shaped section adapted to yieldingly embrace an end of said rib members, and wherein said second-mentioned clamping means is comprised of resililent sheet material having spaced horizontal portions of C-shaped section branched from said vertical portion and adapted to yieldingly embrace said ring members.

3. An article as set forth in claim 2, wherein open ends of said U-shaped and C-shaped sections face in the same direction towards the axial center of the lamp shade and the closed ends thereof are in a common plane substantially coincident with the exterior of said frame.

* * * * *

UNITED STATES PATENT AND TRADEMARK OFFICE

CERTIFICATE OF CORRECTION

PATENT NO. : 4,354,222

DATED : October 12, 1982

INVENTOR(S) : John C. Gall

It is certified that error appears in the above—identified patent and that said Letters Patent is hereby corrected as shown below:

In the Abstract, line 8, after "securing" insert --each--.

Column 1, line 50, after "other" delete "resons" and insert --reasons--.

Column 2, line 60, after "lines" delete "indicatig" and insert --indicating--.

Column 3, line 6, after "is" delete "fructoconical" and insert --frustoconical--.

Column 3, line 45, after "or" insert --of--.

Signed and Sealed this

*Eighteenth* Day of *January 1983*

[SEAL]

*Attest:*

GERALD J. MOSSINGHOFF

*Attesting Officer*

*Commissioner of Patents and Trademarks*